US009956696B2

(12) United States Patent
Davis et al.

(10) Patent No.: US 9,956,696 B2
(45) Date of Patent: May 1, 2018

(54) KNIFE

(75) Inventors: Reuben Jon Davis, Wanganui (NZ); Derek Richard Senior, Dunedin (NZ)

(73) Assignee: Start Food-Tech NZ Limited (NZ)

( * ) Notice: Subject to any disclaimer, the term of this patent is extended or adjusted under 35 U.S.C. 154(b) by 974 days.

(21) Appl. No.: 13/808,914

(22) PCT Filed: Jul. 22, 2011

(86) PCT No.: PCT/IB2011/053269

§ 371 (c)(1),
(2), (4) Date: Jan. 8, 2013

(87) PCT Pub. No.: WO2012/014133

PCT Pub. Date: Feb. 2, 2012

(65) Prior Publication Data

US 2013/0111767 A1 May 9, 2013

(30) Foreign Application Priority Data

Jul. 26, 2010 (NZ) ..... 587005

(51) Int. Cl.
*B26B 9/02* (2006.01)
*B26B 9/00* (2006.01)

(52) U.S. Cl.
CPC . *B26B 9/02* (2013.01); *B26B 9/00* (2013.01)

(58) Field of Classification Search
USPC ..... 30/357
See application file for complete search history.

(56) References Cited

U.S. PATENT DOCUMENTS

| | | | | | |
|---|---|---|---|---|---|
| 2,474,425 | A | * | 6/1949 | Jackson | 30/344 |
| 2,566,112 | A | * | 8/1951 | Barnard | 30/357 |
| 2,636,267 | A | * | 4/1953 | Whitcomb | 30/355 |
| 2,728,140 | A | * | 12/1955 | Krusius | 30/268 |
| 3,116,180 | A | * | 12/1963 | Malzacher | 148/610 |
| 3,201,869 | A | * | 8/1965 | Gambino | 30/342 |
| 3,417,469 | A | * | 12/1968 | Cousins et al. | 30/277.4 |
| 3,488,845 | A | * | 1/1970 | Tausenfreundt | 30/355 |
| 3,514,856 | A | * | 6/1970 | Camp et al. | 30/346.53 |
| 3,616,712 | A | * | 11/1971 | Eickhorn | 76/34 |
| 3,761,374 | A | * | 9/1973 | Bromer et al. | 204/192.11 |
| 3,929,044 | A | * | 12/1975 | Beauchet | 82/46 |
| 4,119,004 | A | * | 10/1978 | Ludwig | 83/661 |
| 4,149,313 | A | * | 4/1979 | Ishida | 30/351 |
| 4,495,698 | A | * | 1/1985 | Gerber, Jr. | 30/357 |
| 4,707,920 | A | * | 11/1987 | Montgomery | 30/294 |
| 4,729,873 | A | * | 3/1988 | Shulz | 420/129 |

(Continued)

*Primary Examiner* — Sean Michalski
(74) *Attorney, Agent, or Firm* — Galbreath Law Offices, P.C.; John A. Galbreath

(57) ABSTRACT

A knife blade with a back, and a cutting edge with a shoulder, characterised in that the knife blade has a blade profile perpendicular to the blade edge that, starting at the shoulder and moving towards the back, has the following thickness, as ground prior to any polishing or subsequent steps, at the position indicated: at the shoulder a thickness of AA; at about 1/16" from the shoulder a thickness of BB; and at about 1/8" from the shoulder a thickness of CC; where AA is about 16 to 23 thousandths of an inch (0.41 mm to 0.58 mm); BB is AA plus about 3 thousandths of an inch (0.076 mm); and CC is BB plus about 2 thousandths of an inch. (0.051 mm).

17 Claims, 3 Drawing Sheets

(56) References Cited

U.S. PATENT DOCUMENTS

| | | | | | |
|---|---|---|---|---|---|
| 4,793,218 | A * | 12/1988 | Jordan et al. | 76/101.1 |
| 4,899,742 | A * | 2/1990 | Muller | 606/180 |
| 4,916,817 | A * | 4/1990 | Atwater | 30/346.55 |
| 5,071,427 | A * | 12/1991 | Stahl | 606/172 |
| 5,181,321 | A * | 1/1993 | Gouttebarge | 30/357 |
| 5,261,922 | A * | 11/1993 | Hood | 606/167 |
| 5,343,623 | A * | 9/1994 | Cole et al. | 30/304 |
| 5,477,616 | A * | 12/1995 | Williams et al. | 30/350 |
| 5,622,184 | A * | 4/1997 | Ashby et al. | 600/585 |
| 5,692,308 | A * | 12/1997 | Di Libero | 30/353 |
| 5,795,648 | A * | 8/1998 | Goel et al. | 428/336 |
| 6,267,033 | B1 * | 7/2001 | Gundlach et al. | 83/42 |
| 6,293,020 | B1 * | 9/2001 | Julien | 30/350 |
| D448,628 | S * | 10/2001 | Yang | D7/649 |
| 6,427,572 | B2 * | 8/2002 | Ciani et al. | 83/676 |
| 6,571,665 | B2 * | 6/2003 | Julien | 76/104.1 |
| 6,698,049 | B2 * | 3/2004 | McLoudrey | 7/158 |
| 6,743,128 | B2 * | 6/2004 | Liechty, II | 473/583 |
| 7,127,820 | B2 * | 10/2006 | Miller | 30/502 |
| 7,204,180 | B2 * | 4/2007 | Schwaiger | 83/613 |
| 7,228,633 | B2 * | 6/2007 | Ryan | 30/346 |
| 7,337,545 | B2 * | 3/2008 | Miltner et al. | 30/138 |
| 7,601,163 | B2 * | 10/2009 | Booth | 606/166 |
| D628,453 | S * | 12/2010 | Green | D8/20 |
| 7,930,831 | B2 * | 4/2011 | Lin | 30/169 |
| 7,963,042 | B2 * | 6/2011 | Keller | 30/350 |
| 8,316,550 | B2 * | 11/2012 | Howells | 30/350 |
| D676,719 | S * | 2/2013 | Hunter | D7/650 |
| 8,776,382 | B2 * | 7/2014 | Ochiai et al. | 30/345 |
| 2002/0078576 | A1 * | 6/2002 | Carr et al. | 30/357 |
| 2002/0083598 | A1 * | 7/2002 | Julien | 30/350 |
| 2002/0144410 | A1 * | 10/2002 | Hufnagel et al. | 30/344 |
| 2008/0016704 | A1 * | 1/2008 | Haneda | 30/357 |
| 2010/0101100 | A1 * | 4/2010 | Hansen et al. | 30/355 |
| 2011/0289780 | A1 * | 12/2011 | Tiegs | 30/123 |
| 2013/0111767 | A1 * | 5/2013 | Davis et al. | 30/357 |

* cited by examiner

KNIFE

TECHNICAL FIELD

The present invention relates to knives, more particularly knives used for processing meat, fish or poultry on or from carcasses.

BACKGROUND ART

Any discussion of the prior art throughout the specification is not an admission that such prior art is widely known or forms part of the common general knowledge in the field.

The profile (vertical cross section) of a knife blade and the way in which this profile varies along the length of the blade determine the performance and longevity of that knife blade. For this reason many different profiles have been used, each with advantages and disadvantages.

FIG. 1 shows, in cross section, a plain carbon steel profile often used prior to the requirement for stainless steel blades in the food processing industry, where the food industry is intended to cover meat, poultry, fish, vegetable etc processing. Stainless steel was required for health reasons, plain carbon steel rusts in these environments and can contaminate the food products produced.

FIG. 2 shows, in cross section, a stainless steel blade which has an edge bevel (edge) that is ground to a different, normally, wider angle than the body of the blade. This wider angle is required due to the properties of stainless steel. It is not practical to grind the whole blade to this wider angle as the blade inward of the cutting edge would be thicker than is necessary, which would increase the amount of work required to move the knife through the material being cut.

To further reduce the drag of the blade behind the cutting edge a variety of knife profiles are used, one of these is termed 'hollow ground'. FIG. 3 shows, in cross section, a hollow ground knife. These knives have a section of the blade adjacent to the cutting edge ground out of the blade, most commonly with a small diameter (3" or 4") grinding wheel, this leaves a raised shoulder between the inner extremity of the cutting edge and the hollow ground section. This shoulder is intended to provide support for the cutting edge. The hollow ground section runs parallel to the peripheral edge of the cutting edge. The hollow ground section reduces the thickness of the blade close to the cutting edge and thus reduces the amount of force needed to use the knife. Unfortunately, as each side of the blade is hollow ground, it creates a thinner section of the blade above the shoulder, this thin section is a weak point. In some cases, when processing for example beef, this thinner section can collapse under normal use, even with the shoulder present.

As a hollow ground knife wears and is resharpened/reground the cutting edge moves into the hollow ground section removing the supporting shoulder and increasing the likelihood of collapse, it also increases the work required to use the knife. The amount of work needed to use the knife in this state can be reduced by grinding the knife with a replacement hollow ground section and remaking the edge, of course this can only be done so often before the blade requires replacement.

In U.S. Pat. No. 2,566,112 H. W. Barnard discloses a knife blade with two parallel adjacent hollow ground sections aimed at providing the advantages of a hollow ground blade during the lifetime of the knife. This type of blade requires two hollow ground sections, each with different radii, are produced in the blade and does not overcome the potential weak sections of blade created by the hollow grind itself.

This type of knife blade will also potentially collapse unless carefully manufactured, and maintained. Though with the two hollow ground sections it is uncertain what would happen as the knife was reground/resharpened to maintain the edge.

U.S. Pat. No. 4,495,698 describes what it calls a 'concave grind' which is similar to a hollow grind but uses a larger radius grinding wheel. One difference over the prior art is that the concave grind does not follow the cutting edge, it runs in a substantially straight line along the length of the blade (Col 2. lines 35 to 41), it does not follow the edge, this provides a blade with the properties of a flat wedge knife and a hollow ground knife. This 'concave grind' is said to avoid the problems associated with a hollow ground knife or very thin knives that tend to break. The concave grind is intended to provide the thin blade cutting properties with the strength and rigidity of a thick blade. U.S. Pat. No. 4,495,698 indicates that the profile essentially follows the surface of a 30" grinding wheel, using the 8" Cooks knife example and calculating the thickness of a blade made this way the blade, as ground, would be 15 thou (0.38 mm) at the edge, 17 thou (0.43 mm) at 1/16", 19 thou (0.49 mm) at 1/8", 24 thou (0.61 mm) at 1/4", 29 thou (0.74 mm) at 3/8" about 40 thou (1 mm) at 1/2" and 80 thou (2 mm) at 1.25", and table 1 gives 15 thou at the edge, 40 thou at the midpoint (about 1/2" up) and 80 thou at the back (though this may just be the blank thickness). For succinctness we use the standard shortened form of thousandths of an inch, thou, for thickness measurements (where 1 thousandths of an inch is 0.0254 mm). U.S. Pat. No. 4,495,698 specifically has an object of cutting through the entire thickness of crisp vegetables, and to accomplish this objective the inventor has created a blade with the side faces slightly concave over their entire width. This concave grind is said to give the cutting characteristics of a thin blade with the strength and rigidity of a thick blade which is desirable and overcomes the problems with very thin blades for kitchen use. Certain types of knives, for example boning and filleting knives depend on the flexibility of the tip to manoeuvre around bones, with the profile described in U.S. Pat. No. 4,495,698 running straight along the length of the blade the back needs to be ground to achieve this. With an as ground thickness of 15 thou the finished blade edge thickness will be less than this, this is unlikely to be suitable for some applications.

When a knife blade is blunt, or has been damaged it may need to be reground to reset the cutting edge, this is risky process as around 50% of knife wear comes from incorrect aftermarket grinding.

DISCLOSURE OF INVENTION

It is an object of the present invention to provide a knife and/or knife blade profile that overcomes at least one of the deficiencies of mentioned above, or at least provide the consumer with a useful choice.

The present invention provides a knife blade with a back, and a cutting edge with a shoulder, such that the knife blade has a blade profile perpendicular to the blade edge that, starting at the shoulder and moving towards the back has the following thickness, as ground prior to any polishing or subsequent steps, at the position indicated:

at the shoulder a thickness of AA;

at about 1/16" from the shoulder a thickness of BB;

where AA is about 16 to 23 thousandths of an inch (0.41 mm to 0.58 mm) and BB is AA plus about 3 thousandths of an inch (0.076 mm).

Preferably the blade thickness at about ⅛" from the shoulder is CC; where CC is BB plus about 2 thousandths of an inch.

Preferably the blade thickness at about ¼" from the shoulder is DD; where DD is CC plus about 4 thousandths of an inch.

Preferably the blade thickness at about ⅜" from the shoulder is EE; where EE is CC plus about 9 to 20 thousandths of an inch.

Preferably the blade thickness at about ½" from the shoulder is FF; where FF is EE plus about 8 thousandths of an inch or greater.

Preferably the blade thickness at about ½" from the shoulder is FF; where FF is greater than about 50 thousandths of an inch.

Preferably if the blade at any point, other than the tip, is narrower than the dimension given, then that thickness is not present.

In a highly preferred form the as ground shoulder thickness is about 17 thousandths of an inch. Preferably in this form BB=20 thousandths of an inch; CC=22 thousandths of an inch; DD=26 thousandths of an inch; EE=41 thousandths of an inch; and FF=56 thousandths of an inch, where the measurements give are all within about 0.5 thousandths of an inch of the value given.

Preferably the blade is polished after being ground, in this case the polishing reduces the as ground thickness, independently at each specified point, by between about 0 and 1 thousandths of an inch.

Preferably the blade is glazed and polished, in this case the glazing and polishing reduces the as ground thickness, independently at each specified point, by between about 1 and 5 thousandths of an inch.

The present invention also includes a knife incorporating the knife blade.

In a preferred form the knife is a boning knife with a rake of between 29 mm and 35 mm. In a highly preferred form this rake is 32 mm.

BRIEF DESCRIPTION OF DRAWINGS

For clarity the prior art is shown in the following accompanying drawings, in which.

Figures 1, 2, 3, 4:
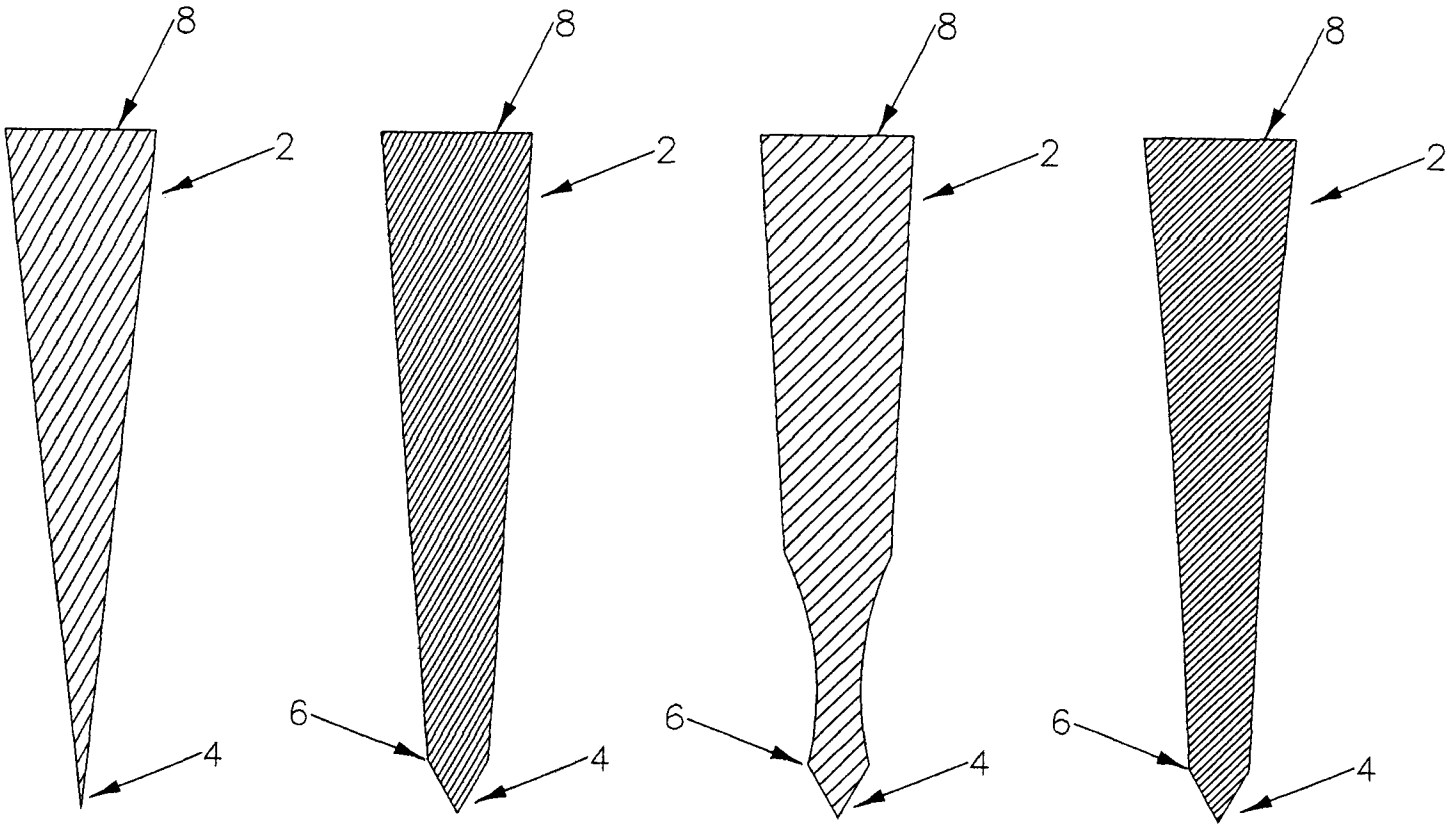
Fig.1 (PRIOR ART)
Fig.2 (PRIOR ART)
Fig.3 (PRIOR ART)
Fig.4 (PRIOR ART)
FIG. 1 shows a cross sectional view of a carbon steel knife blade.
FIG. 2 shows a cross sectional view of a stainless steel knife blade.
FIG. 3 shows a cross sectional view of a hollow ground knife blade, as manufactured.
FIG. 4 shows a cross sectional view of a knife blade with the profile described in U.S. Pat. No. 4,495,698, i.e. a concave grind.
Figure 5:
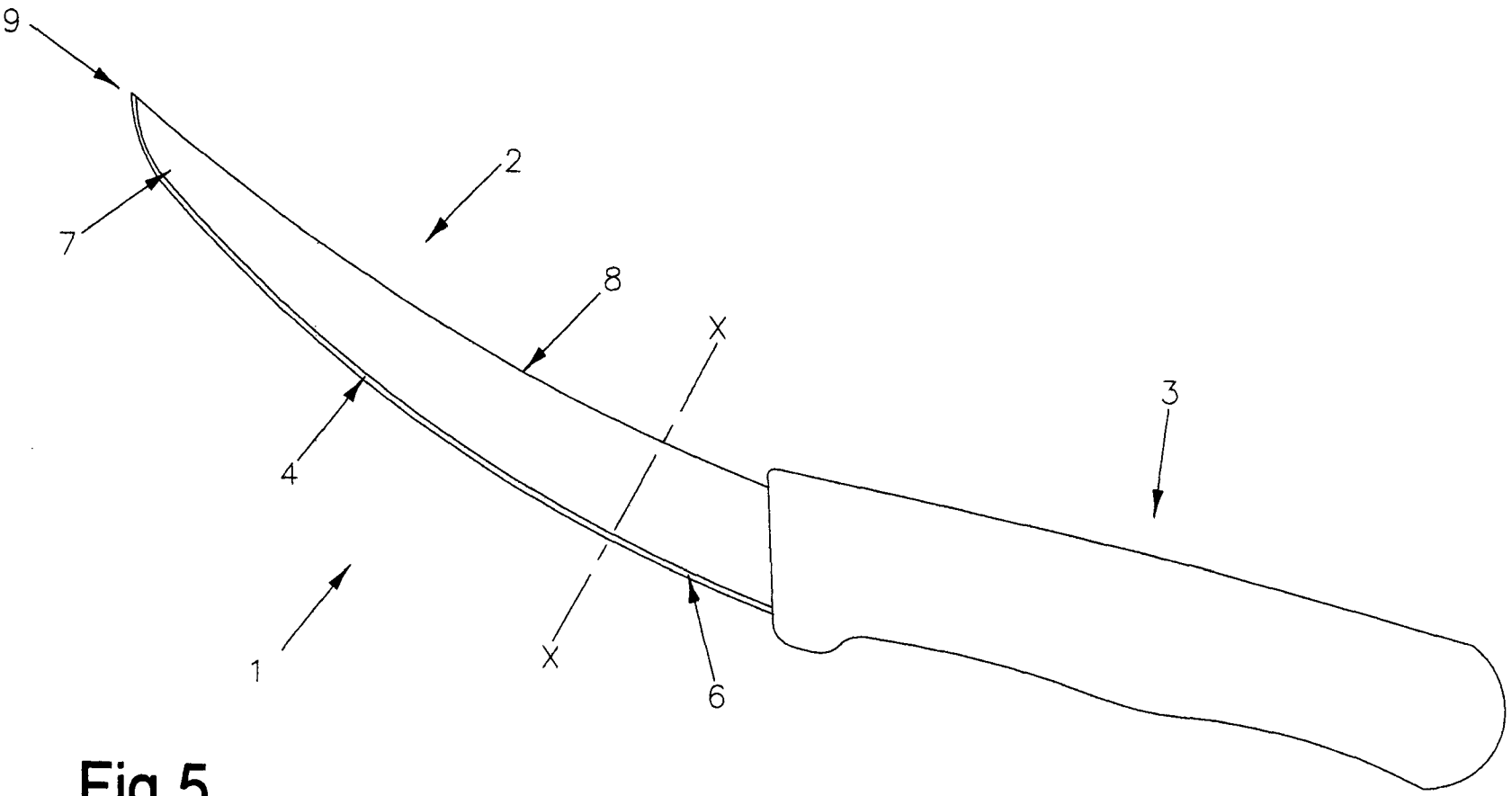
Figure 7:
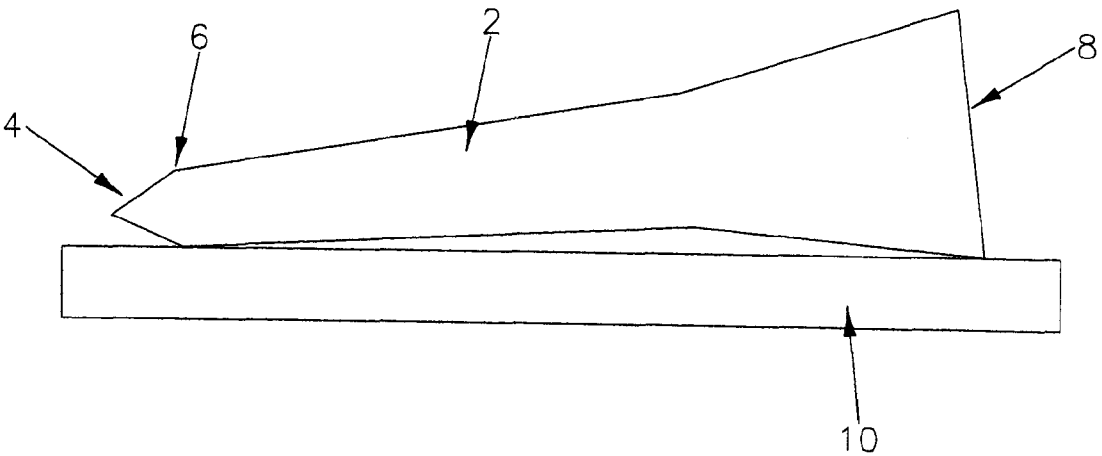
Figure 6:
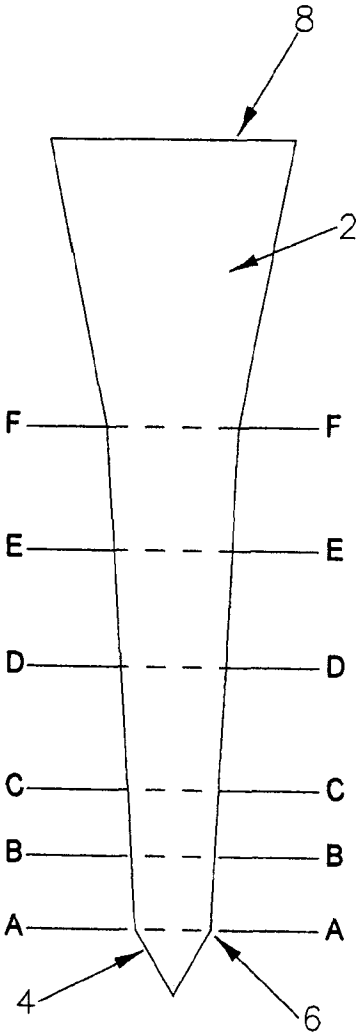

By way of example only, a preferred embodiment of the present invention is described in detail below with reference to the accompanying drawings, in which:

FIG. 5 shows a side view of a knife with the blade profile of the invention;

FIG. 6 shows a cross sectional view through X-X;

FIG. 7 shows a cross sectional view of the blade lying against a surface.

BEST MODE FOR CARRYING OUT THE INVENTION

Referring to FIG. 5 a knife (1) including a blade (2) and a handle (3) is shown. The blade (2) includes a cutting edge (4), a shoulder (6), tip (7) and back (8), where the tip (7) is the section of the blade (2) at the end of the blade (2) furtherest from the handle (3).

The cutting edge (4) is the section of blade (2) that actually cuts the material being processed, the thickest part of the cutting edge (4) is the shoulder (6). The thinnest section of the cutting edge (4) forms a peripheral edge of the blade (2). The back (8) is the peripheral edge of the blade (2) opposite the cutting edge (4) that, if the blade has a point (9), meets the cutting edge (4) at the point (9). The point (9) forms the extreme exposed end of the blade (2) when present.

The cutting edge (4) in cross section is an isosceles triangle with the base formed by the shoulders (6) and the thinnest section forming the vertex. The angle of the cutting edge (4) is dependent on the material used for the blade (2).

Now the back (8) is sometimes referred to as the 'spine', however, the spine is not always a peripheral edge of the blade (2), so the term back (8) will be used herein. The spine is simply the path formed by the thickest section (across the width of the blade (2) running from handle (3) to tip (7). For succinctness we will use the standard shortened form of thousandths of an inch, thou, for thickness measurements (where 1 thousandths of an inch is 0.0254 mm).

Referring to FIG. 6 a cross sectional view through the knife (5) along the line X-X is shown, this cross section is approximately 1 inch (25 mm) along the blade (2) from the handle (3) and is the desired blade (2) profile. This desired blade (2) profile continues along the length of the blade (2) following the line of the cutting edge (4). The blade (2) profile smoothly transitions to the profile at the intersection between the handle (3) and the blade (2) at that point. As the blade (2) profile extends from the shoulder (6) away from the cutting edge (4), all the way to the point (9), the blade (2) profile at the tip (7) extends along the back (8) towards the handle (3) from the point (8). This reduces the thickness of the blade (2) at the tip (7) and increases the flexibility of the tip (7).

The thickness of the blade (2), as ground, at the shoulder (6) along the line A-A is 16 to 23 thou (0.41 to 0.58 mm), 1/16" (about 1.6 mm) away from the shoulder (6) in the direction of the back (8), along the line B-B, the thickness of the blade (2) is 19 to 26 thou (0.48 to 0.66 mm) and at ⅛" (about 3.2 mm) away from the shoulder (6) in the direction of the back (8), along the line C-C, the thickness of the blade (2) is 21 to 28 thou (0.53 to 71 mm). At ¼" (about 6.4 mm) away from the shoulder (6) in the direction of the back (8), along line D-D, the thickness of the blade (2) is 25 to 32 thou (0.64 to 0.81 mm), at ⅜" (about 9.5 mm) away from the shoulder (6) in the direction of the back (8), along the line E-E, the thickness of the blade (2) is 41 to 48 thou (1.04 to 1.22 mm) and at ½" (about 12.7 mm) away from the shoulder (6) in the direction of the back (8), along the line F-F, the thickness of the blade (2) is greater than 55 thou (1.27 mm). The thickness of the blade (2) at the back (8) depends upon the width of the blade (2) at that point, if the width of the blade (2) is less than ½" then the thickness will match the blade (2) profile described, if greater than this it is likely to lie between 40 thou (1.02 mm) and 80 thou (2.04 mm). The blade (2) profile smoothly transitions between these thicknesses, across and along the blade (2). Please note that all figures given are +/−1 thou, except for FF which is dependent on the material used as it is a transition point through to the blank thickness.

Please note that though ranges of figures are given for the blade (2) profile the thickness at any given cross section follows the following pattern, using the cross section lines A-A to F-F;

A-A is 16 to 23 thou;
B-B is A-A+3 thou;
C-C is A-A+5 thou (B-B+2 thou);
D-D is A-A+9 thou (C-C+4 thou);
E-E is A-A+25 thou (D-D+16 thou);
F-F is greater than about 55+/−10 thou.

Giving the following table, Table 1, of as ground profiles, noting that even though whole thousandths of an inch are given this does not exclude fractional figures:

TABLE 1

| Shoulder or section A-A | 1/16" from shoulder or section B-B | 1/8" from shoulder or section C-C | 1/4" from shoulder or section D-D | 3/8" from shoulder or section E-E | 1/2" from shoulder or section F-F |
|---|---|---|---|---|---|
| 16 | 19 | 21 | 25 | 41 | >50 |
| 17 | 20 | 22 | 26 | 42 | >50 |
| 18 | 21 | 23 | 27 | 43 | >50 |
| 19 | 22 | 24 | 28 | 44 | >50 |
| 20 | 23 | 25 | 29 | 45 | >50 |
| 21 | 24 | 26 | 30 | 46 | >50 |
| 22 | 25 | 27 | 31 | 47 | >55 |
| 23 | 26 | 28 | 32 | 48 | >55 |

All thicknesses are in thousandths of an inch and +/− 1 thou.

It should be noted that all of the thicknesses given are as ground, this is prior to any polishing or later processing/finishing steps. This means that a finished blade (2) may well be thinner than the thicknesses given here. The following table, Table 2, provides as ground and finished thicknesses (though they are only a guide at best and variation is expected). The blade (2) profile may well vary due to variations across the blade (2) during the glazing and/or polishing

TABLE 2

| Type of knife | Shoulder thickness (section A-A) as ground | Shoulder thickness (section A-A) after polish | Shoulder thickness (section A-A) after glaze and polish |
|---|---|---|---|
| 6" curved boning | 18 | 17 to 18 | 14 to 16 |
| | 19 | 18 to 19 | 16 to 18 |
| | 21 | 20 to 21 | 18 to 20 |
| | 23 | 22 to 23 | 20 to 21 |
| 5" curved boning | 17 | 15 to 16 | 12 to 14 |
| | 19 | 18 | 14 to 15 |
| | 21 | 20 to 21 | 17 to 18 |
| | 23 | 22 | 20 to 21 |

All measurements in thousandths of an inch, and +/− 1 thou.

Because the blade (2) profile follows the cutting edge (4) to the tip (7) and extends from the point (9) to the handle (3) down the back (8) of the blade (2), a user can shape the tip (7) to their preference yet still retain cutting performance. Of course there are limits to how much the tip (7) can be modified as the blade (2) profile only extends so far along the back (8).

Referring to FIG. 7 the blade (2) is shown in cross section resting against a flat surface (10), in this position the shoulder (6) of the blade (2) and the back (8) of the blade (2) are the only points touching the flat surface (10). The shoulder (6) or cutting edge (4) will always be one of the contact points, the back (8) may not always be. Because these points are the only ones touching the surface this may produce less drag on the blade (2) in use.

It should also be noted that the blade (2) profile given is material dependant and, though preferred for the grades of stainless steels presently used. If a different material is used then the blade (2) profile may commence from a thinner shoulder (6), the rest of the dimensions similarly reduced.

It should be noted that this profile eliminates the narrowing behind the shoulder (6) found in hollow ground blades (2), which is a weak point.

For boning out carcasses the knife (1) is held the same as for stabbing downwards, sometimes called a 'dagger grip' for around 80% of the time. For many knives (1) the rake is effectively 0 whereas it has been found that a rake of 32 mm+/−10% is, for boning knives, desirable. For clarity the rake is the height of the point (9) above the handle (3), providing the point (9) is the part of the tip (7) that gives the maximum height. To put this another way, it is the offset between a line drawn along the handle (3) and a parallel line drawn through the point (9) of the blade (2).

In other embodiments the knife (1) may include the blade (2) profile but not the preferred rake, for example for vegetable or other knives.

Results

Surprisingly a knife (1) with this blade (2) profile, with an as ground shoulder (6) thickness of 17 thou, has been found to need little maintenance, a light steel seems to return the edge quickly when necessary. Even a nick in the cutting edge (4) that would normally have required setting a new cutting edge (4) was able to be removed by a steel. Given the glazed and polished thickness of this knife (1) it is a surprising result, as previously knives (1) with blades (2) this thin have had durability issues. From trials the cutting edge (4) is retained longer than normal knives (1) and so a steel is used less, in fact for one trial only a steel was used for the first 10 months.

From one trial, still ongoing, it would appear that the blade (2) profile when used on a boning knife extends the life by at least a factor of 3. Now some of this may be due to the user of the knife (1) but in the same length of time most users would have worn out 3 knives. This trial has now run for an extended period and it was 10 months before the knife needed the first stoning, and even this was minor. The knife after stoning returned to looking as new and is still in use.

From brief trials using a boning knife with the blade (2) profile described increased the yield by between 1% and 4% (though this needs to be confirmed by more robust measurement). This is a significant gain as it is achieved with less effort than currently required. A full scale yield trial needs to be undertaken to confirm this, but as the knife profile is thinner than currently used knives there is less effort thus less meat being levered around.

The reduction in the force required to use the knife is as yet unknown but one trial with a boning knife required noticeably less effort to use.

Thicknesses E-E and F-F are less critical than the others and it is believed that an embodiment with the following profile may also work:

A-A is 16 to 23 thou
B-B is A-A+3 thou;
C-C is A-A+5 thou (B-B+2 thou);
D-D is A-A+9 thou (C-C+4 thou);
E-E is A-A+14 thou (D-D+5 thou);
F-F is A-A+22 thou (E-E+8 thou).

The above profile has not yet been confirmed as practical, though E-E and F-F are the only changes from the preferred embodiment as they are believed to be less critical.

The results of a further trial carried out on mutton and lamb, found that there was around 9% less cutting force and 3% less peak effort required to achieve the same results as a normal hollow ground knife. A 9% reduction in cutting force is a significant reduction. It should be noted that although the users in the trial were skilled meat processing workers they had not been specifically trained in the use of the knife ground with the inventive profile. One user was shown how to use the knife and immediately his figures improved still further, however these figures were discounted from the study results as they could be seen as skewing the results.

This 9% reduction in required cutting force, and extended time between sharpening, will result in less fatigue and potentially a lower incidence of musculoskeletal disorders in users of knives with this profile. It has been shown that fatigue can affect the quality so less wastage is expected.

A fish trial has found that even with a group of users with less than optimum sharpening techniques the life of a knife with this blade profile is at least three times that of knives used for similar purposes. This was whilst requiring less force even when blunt. It is believed that trained operators will extend the life of the knives still further.

ITEM LIST

1 knife
2 blade
3 handle
4 cutting edge
5 .
6 shoulder
7 tip
8 back
9 point
10 flat surface.

The invention claimed is:

1. A stainless steel knife blade with a back, and a cutting edge with a shoulder, characterised in that the knife blade has a blade profile perpendicular to the blade edge that, starting at the shoulder and moving towards the back, has the following thickness, as ground prior to any polishing or subsequent steps, at the position indicated:

at the shoulder a thickness of AA;

at about 1/16" from the shoulder a thickness of BB; and at about 1/8" from the shoulder a thickness of CC;

where AA is about 16 to 23 thousandths of an inch (0.41 mm to 0.58mm);

BB is AA plus about 3 thousandths of an inch (0.076 mm); and

CC is BB plus about 2 thousandths of an inch (0.051 mm).

2. The knife blade as claimed in claim 1 characterised in that the blade thickness at about 1/4" from the shoulder is DD; where DD is CC plus about 4 thousandths of an inch (0.102 mm).

3. The knife blade as claimed in claim 2 characterised in that the blade thickness at about 3/8" from the shoulder is EE; where EE is CC plus about 9 to 20 thousandths of an inch.

4. The knife blade as claimed in claim 3 characterised in that the blade thickness at about 1/2" from the shoulder is FF; where FF is EE plus about 8 thousandths of an inch or greater.

5. The knife blade as claimed in claim 3 characterised in that the blade is polished after being ground, in this case the polishing reduces the as ground thickness, independently at each specified point, by between about 0 and 1 thousandths of an inch.

6. The knife blade as claimed in claim 2 characterised in that the blade is polished after being ground, in this case the polishing reduces the as ground thickness, independently at each specified point, by between about 0 and 1 thousandths of an inch.

7. The knife blade as claimed in claim 1 characterised in that the blade thickness at about 3/8" from the shoulder is EE; where EE is CC plus about 9 to 20 thousandths of an inch.

8. The knife blade as claimed in claim 7 characterised in that the blade thickness at about 1/2" from the shoulder is FF; where FF is EE plus about 8 thousandths of an inch or greater.

9. The knife blade as claimed in claim 8 characterised in that BB=20 thousandths of an inch; CC=22 thousandths of an inch; DD=26 thousandths of an inch; EE=41 thousandths of an inch; and FF=56 thousandths of an inch, where the measurements given are all within about 0.5 thousandths of an inch of the value given.

10. The knife blade as claimed in claim 9 characterised in that the blade is polished after being ground, in this case the polishing reduces the as ground thickness, independently at each specified point, by between about 0 and 1 thousandths of an inch.

11. The knife blade as claimed in claim 7 characterised in that the blade is polished after being ground, in this case the polishing reduces the as ground thickness, independently at each specified point, by between about 0 and 1 thousandths of an inch.

12. The knife blade as claimed in claim 1 characterised in that that the blade thickness at about 1/2" from the shoulder is FF; where FF is greater than about 50 thousandths of an inch.

13. The knife blade as claimed in claim 1 characterised in that the shoulder thickness is about 17 thousandths of an inch.

14. The knife blade as claimed in claim 1 characterised in that the blade is polished after being ground, in this case the polishing reduces the as ground thickness, independently at each specified point, by between about 0 and 1 thousandths of an inch.

15. A knife including the knife blade as claimed in claim 1.

16. The knife as claimed in claim 15 characterised in that the knife is a boning knife with a rake of between 29 mm and 35mm.

17. The knife as claimed in claim 16 characterised in that the rake is 32mm.

* * * * *